US006273585B1

(12) United States Patent
Wu

(10) Patent No.: US 6,273,585 B1
(45) Date of Patent: Aug. 14, 2001

(54) STRUCTURE BATHROOM-USE MIRROR LAMP

(76) Inventor: Wen-Chang Wu, No No.10, 191 Lane, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/394,887

(22) Filed: Sep. 13, 1999

(51) Int. Cl.[7] ..... F21V 33/00

(52) U.S. Cl. ..... 362/135; 362/136; 362/139; 362/144; 362/427; 362/413; 403/83; 403/84; 403/92

(58) Field of Search ..... 362/135, 141, 362/144, 136, 139, 140, 427, 413; 403/83, 84, 86, 91, 92, 98

(56) References Cited

U.S. PATENT DOCUMENTS 388,346 * 8/1888 Duff ..... 362/135

1,667,545 * 4/1928 Doddard ..... 362/135

* cited by examiner

*Primary Examiner*—Sandra O'Shea
*Assistant Examiner*—Bertrand Zeade
(74) *Attorney, Agent, or Firm*—Dougherty & Troxell

(57) ABSTRACT

An improved bathroom-use mirror lamp having a mirror lamp and gimbal frame that are capable of a flexible range of angular adjustment. A gimbal frame is situated on the upper extent of the lower base, and a mirror lamp is mounted to the gimbal frame, with the gimbal frame containing internally routed electrical wiring. The electrical wiring of the mirror lamp is routed from the interior section of the mirror lamp through the two lateral arms of the gimbal frame and extended out at the bottom end of the lower base. The gimbal frame and mirror lamp each have a laterally disposed semicircular shaped recess at a connection section with a position limiting ball bearing in each. When the mirror lamp is rotated 180 degrees, the position limiting ball bearings become restricted against two edges of the insertion conjointment slots, causing the mirror lamp to become incapable of further rotation and preventing the twisting of the electrical wiring.

3 Claims, 5 Drawing Sheets

211

32
3
32
4
31
A
B
21
311
4
21
31
32

3
2

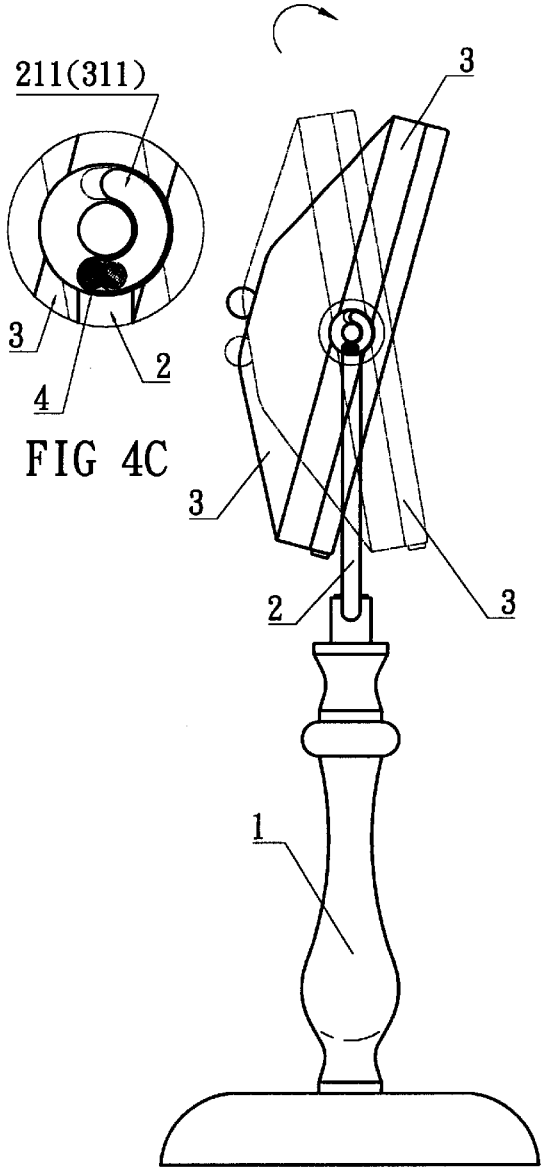
FIG 4C
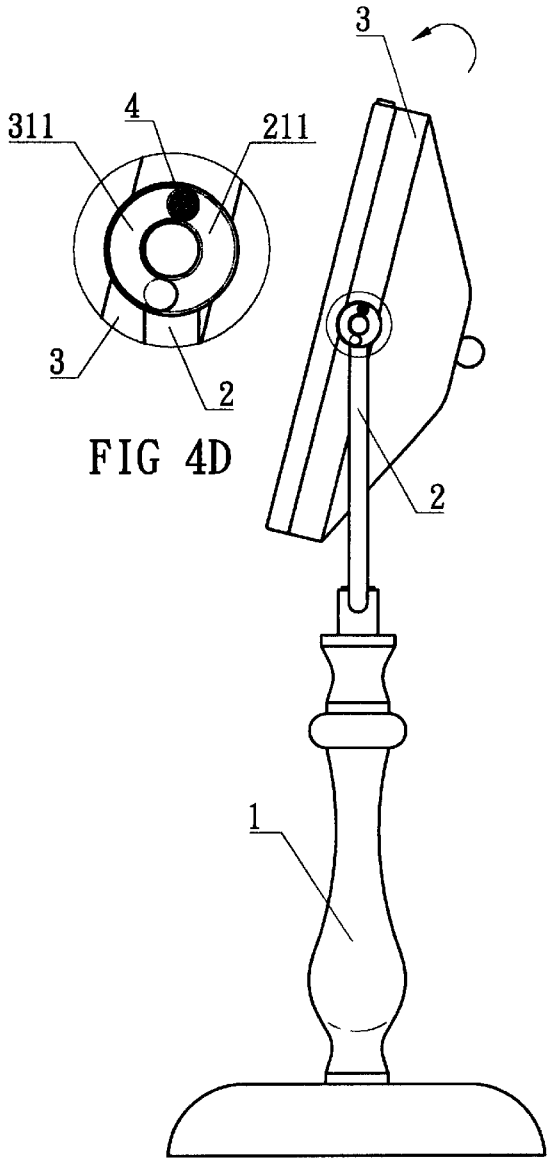
FIG 4D
FIG 4A
FIG 4B

STRUCTURE BATHROOM-USE MIRROR LAMP

BACKGROUND OF THE INVENTION

1) Field of the Invention

The invention herein relates to an improved bathroom-use mirror lamp in which the electrical wiring of the mirror lamp is hidden inside its gimbal frame and lower base to remain unexposed. In the innovative structure of the present invention, the gimbal frame and mirror lamp each have a laterally disposed semicircular shaped recess at a connection section and, furthermore, a pair of insertion conjoinment slots in a crossed intersectional arrangement that function in coordination with a position limiting ball bearing in each of the insertion conjoinment slots at the two sides of the connecting section such that after the mirror lamp is rotated 180 degrees forward or backward, the position limiting ball bearings become restricted against two edges of the insertion conjoinmenit slots, causing the mirror lamp to be incapable of further rotation and thereby preventing the twisting of the electrical wiring inside the gimbal mount. As such, the improved bathroom-use minior lamp of the present invention achieves an enhanced appearance and, furthermore, provides a mirror lamp and gimbal frame capable of a full range of angular adjustment.

2) Description of the Prior Art

Conventional mirror lamps, as indicated in FIGS. 1A and 1B, are comprised of a lower base 1, a gimbal frame 2 situated on the upper extent of the lower base 1, and a mirror lamp 3 that is mounted to a gimbal frame 2 in which the electrical wiring 32 of the mirror lamp 3 is housed. The electrical wiring 32 of the said mirror lamp 3 extends from an insertion hole 33 in the bottom end of the mirror lamp 3 and, furthermore, is then inserted into the top end of the support rod 11 of the lower base 1 and emerges from the lower extent of the lower base 1 to thereby achieve its decorative and mirror surface illumination functions. However, such mirror lamp structures have numerous shortcomings due to structural defects that await further connection and improvement by manufacturers, including the following examples.

1. Unattractive Appearance

The electrical wiring 32 of the conventional mirror lamp 3 extends from an insertion hole 33 in the bottom end of the mirror lamp 3 and, furthermore, is then inserted into the top end of the support rod 11 of the lower base 1 and emerges from the lower extent of the lower base 1 such that the electrical wiring 32 is exposed in an area between the mirror lamp 3 and the lower base 1, which detracts from the overall appearance of the mirror lamp 3.

2. Rotation Angle Incapability

The electrical wiring 32 of the conventional mirror lamp 3 extends from an insertion hole 33 in the bottom end of the mirror lamp 3 and, furthermore, is then inserted into the top end of the support rod 11 of the lower base 1 and emerges from the lower extent of the lower base 1 such that the mirror lamp 3 is limited to its original position by the obstruction posed by the electrical wiling 32 and remains incapable of angular rotation, thereby precluding the angular adjustment of the mirror lamp 3 and the gimbal frame 2.

SUMMARY OF THE INVENTION

The primary objective of the invention herein is to provide an improved bathroom-use mirror lamp comprised of a desktop placeable lower base, a gimbal frame situated on the upper extent of the lower base, and a mirror lamp mounted to the gimbal frame, with the gimbal frame containing internally routed electrical wiring, wherein the gimbal frame and mirror lamp each have a laterally disposed semicircular shaped recess in a connection section and, furthermore, a pair of insertion conjoinment slots in a crossed intersectional arrangement that function in coordination with a position limiting ball bearing in each of the insertion conjoinment slots at the two sides of the connecting section such that after the mirror lamp is rotated 180 degrees forward or backward, the position limiting ball bearings become restricted against two edges of the insertion conjoinment slots, causing the mirror lamp to be incapable of further rotation and thereby preventing the twisting of the electrical wiring inside the gimbal mount. The improved bathroom-use mirror lamp of the present invention provides a mirror lamp and gimbal frame capable of a full range of angular adjustment.

Another objective of the invention herein is to provide an improved bathroom-use mirror lamp in which the electrical wiring of the said minior lamp is routed from the interior section of the minior lamp through the two lateral arms of the gimbal frame and extended out at the bottom end of the lower base, enabling the electrical wiring of the mirror lamp to be hidden inside the gimbal frame and the lower base to effectively achieve an attractive appearance.

Yet another objective of the invention herein is to provide an improved structure bathroom-use mirror lamp that does not involve undue considerations of precision during fabrication because the gimbal frame and minior lamp only have two insertion conjoinment slots at the sides of a connecting section as well as locking position limiting ball bearings such that when the insertion conjoinment slots of the connecting sections at the two sides of the mirror lamp are not aligned, the adjustable angular rotation capability of the gimbal frame and the mirror lamp remain unaffected, thereby precluding precision priorities during fabrication.

BRIEF DESCRIPTION OF THE DRAWINGS

FIG. 4A is a side view of the invention herein when the mirror lamp is rotated forward.

FIG. 4B is a side view of the invention herein when the mirror lamp is rotated backward.

FIG. 4C is a partial view illustrating the position of the ball bearing when the lamp is oriented in the position shown in FIG. 4A.

FIG. 4D is a partial view illustrating the position of the ball bearing when the lamp is oriented in the position shown in FIG. 4B.

DETAILED DESCRIPTION OF THE PREFERRED EMBODIMENTS

Figure 1A:
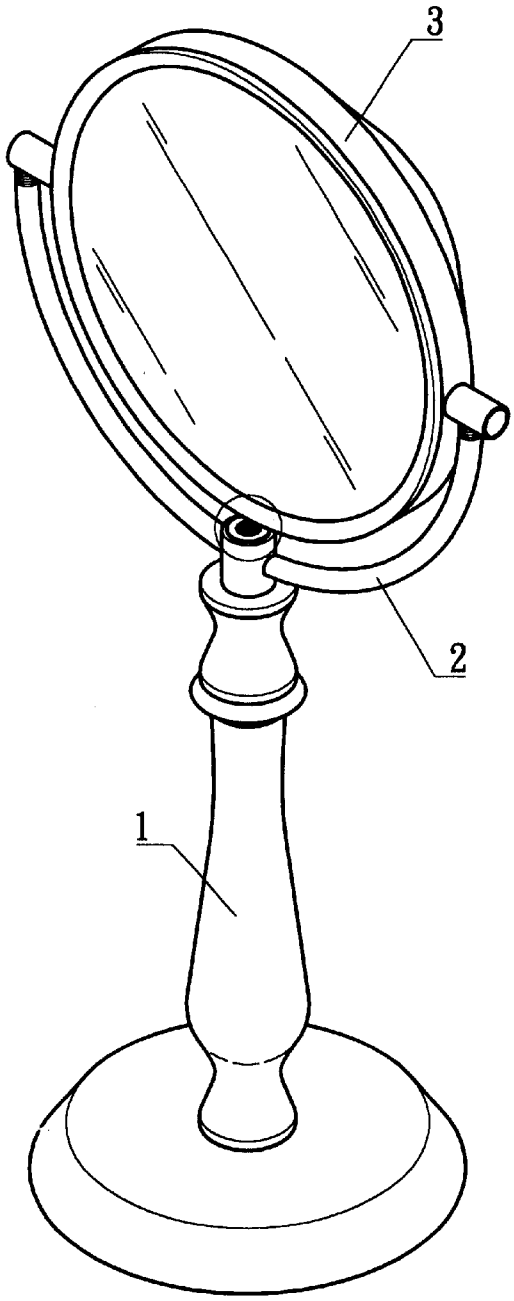
FIG 1A PRIOR ART
FIG. 1A is a perspective view of a conventional mirror lamp.
Figure 1B:
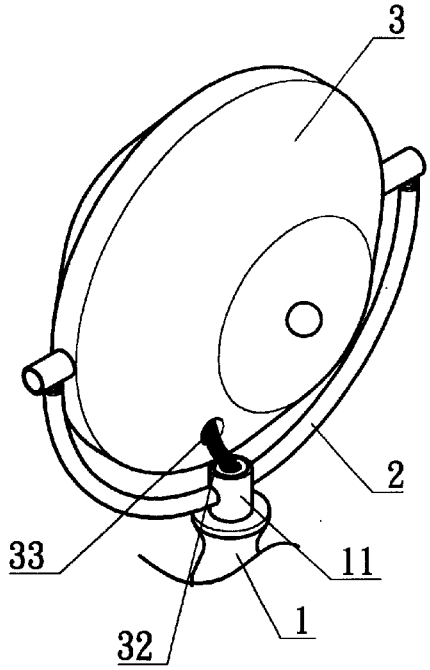
FIG 1B PRIOR ART
FIG. 1B is a partial perspective view of the mirror lamp of FIG. 1A.
Figures 2A, 2B, 2C:
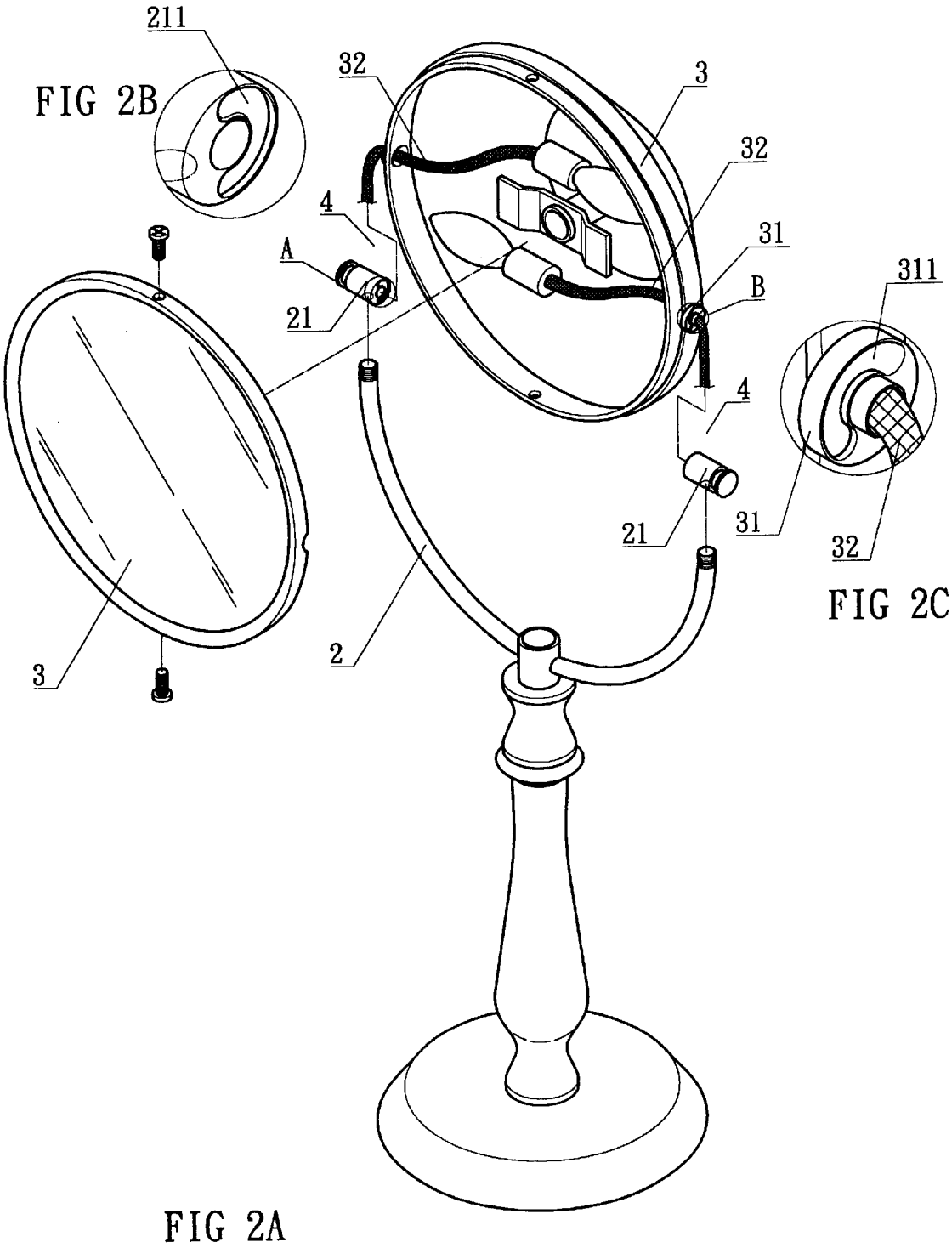
FIG. 2A is an exploded drawing of the mirror lamp of the invention herein.
FIG. 2B is a partial, enlarged view of area A in FIG. 2A.
FIG. 2C is a partial, enlarged view of area B in FIG. 2A.
Figure 3:
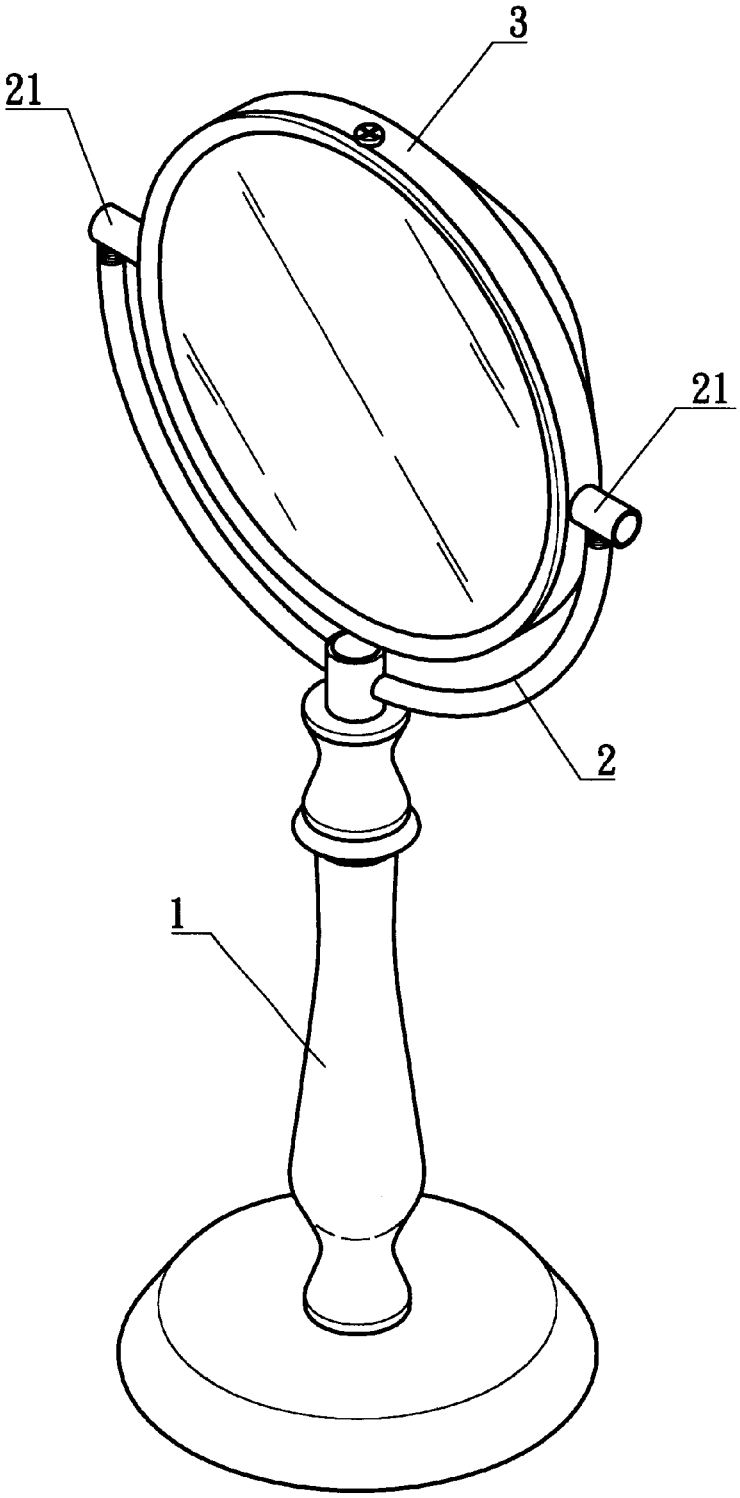
FIG. 3 is an isometric drawing of the invention herein.

Referring to FIG. 2 and FIG. 3, the structure of the invention herein is comprised of a desktop placeable lower base 1, a gimbal frame 2 situated on the upper extent of the lower base 1, and a mirror lamp 3 that is mounted to the gimbal frame 2, with the gimbal frame 2 containing internally routed electrical wiring 32, of which:

The electrical wiring 32 of the said mirror lamp 3 is insertion routed from the interior section of the mirror lamp 3 through the two lateral alms of the gimbal frame 2 and extended out at the bottom end of the lower base 1, enabling the electrical wiring 32 of the mirror lamp 3 to be hidden inside the gimbal frame 2 and the lower base 1 to effectively achieve an attractive appearance.

The gimbal frame 2 and mirror lamp 3 are conjoined together at two extremities by a connecting section, with the said connecting section consisting of a pivot mount 21 affixed to each of the two ends of the gimbal frame 2 and a link pin 31 situated at each of the two sides of the mirror lamp 3, with the said pivot mount 21 and link pin 31 each having a laterally disposed semicircular shaped recess and, furthermore, insertion conjoinment slots 211 and 311 in a crossed intersectional arrangement that function in coordination with a position limiting ball bearing 4 in each of the two insertion conjoinment slots 211 and 311 at the two sides of the connection section.

Referring to FIGS. 4A–4D, during the operation of the invention herein, when the mirror lamp 3 is rotated 180 degrees forward or backward, the position limiting ball bearings 4 become restricted against two edges of the insertion conjoinment slots 211 and 311, causing the mirror lamp 3 to become incapable of further rotation and thereby preventing the twisting of the electrical wiring 32 inserted through the inside of the gimbal frame 2. Since the electrical wiring 32 of the mirror lamp 3 is hidden within the gimbal frame 2 and the lower base 1, the improved bathroom-use mirror lamp of the present invention achieves an attractive appearance and, furthermore, provides a mirror lamp 3 and gimbal frame 2 that are capable of a full range of angular adjustment.

Figure 5:
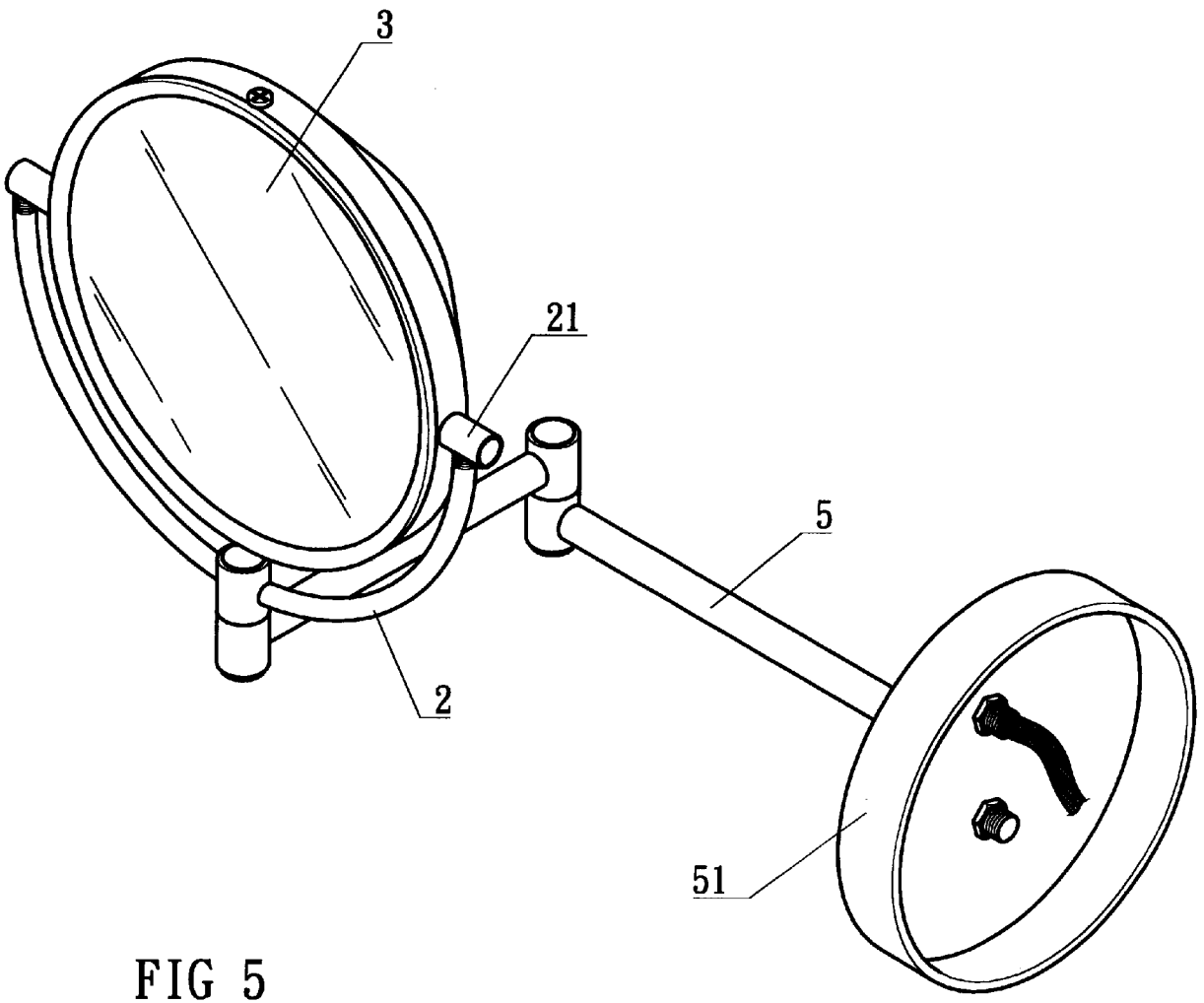
FIG. 5 is an isometric drawing of another embodiment of the invention herein.

Referring to FIG. 5, the said mirror lamp structure is also capable of accommodating a horizontally disposed support member 5 at the lower section of the mirror lamp 3 and, furthermore, the end section 51 of the support member 5 can be mounted to a wall surface by means of fastening screws, thereby achieving another embodiment of the invention herein.

What is claimed is:

1. A bathroom-use mirror lamp comprising:

a) a mirror lamp assembly having at least one electrical light source therein;

b) a curved gimbal frame having an interior and two opposite end portions;

c) a pivot mount located on each of the two opposite end portions, each pivot mount having an end facing the mirror lamp with a first conjointment slot therein;

d) link pins extending from the mirror lamp assembly so as to pivotally connect the mirror lamp assembly to the pivot mounts such that the mirror lamp assembly is located between the opposite end portions of the gimbal frame, each link pin having a second conjointment slot therein adjacent to a corresponding first conjointment slot;

e) a position limiting ball in both of the adjacent first and second conjointment slots so as to limit pivoting movement of the mirror lamp assembly relative to the gimbal frame; and, f) electrical wiring connected to the at least one light source and extending through at least one of the link pins, the associated pivot mount, and through the interior of the gimbal frame.

2. The bathroom-use mirror lamp of claim 1 further comprising a lower base attached to the curved gimbal frame.

3. The bathroom-use mirror lamp of claim 1 further comprising a wall-mounted support member attached to the curved gimbal frame.

* * * * *